United States Patent [19]

Haury et al.

[11] 4,307,358

[45] Dec. 22, 1981

[54] ELECTROMAGNETIC CONTACTOR IS FITTED WITH AN ELECTROMAGNET SENSITIVE TO OVER-CURRENTS, TO CAUSE THE LIMITATION AND CUT-OFF OF EXCESS CURRENTS

[75] Inventors: André Haury, le Raincy; Lucien Siffroi, Versailles, both of France

[73] Assignee: La Telemecanique Electrique, France

[21] Appl. No.: 958,473

[22] Filed: Nov. 7, 1978

[30] Foreign Application Priority Data

Nov. 8, 1977 [FR] France ..... 77 34366

[51] Int. Cl.[3] ..... H01H 77/10; H01H 75/10

[52] U.S. Cl. ..... 335/6; 335/173; 335/175

[58] Field of Search ..... 335/6, 14, 132, 175, 335/16, 170, 171, 174, 173, 172

[56] References Cited

U.S. PATENT DOCUMENTS

| | | | |
|---|---|---|---|
| 3,158,711 | 11/1964 | Piteo | 335/173 |
| 3,430,164 | 2/1969 | Hurtle | 335/173 |
| 3,914,720 | 10/1975 | Drubig | 335/14 |
| 4,025,883 | 5/1977 | Slade et al. | 335/132 |
| 4,042,895 | 8/1977 | Wafer et al. | 335/6 |

*Primary Examiner*—Harold Broome

*Attorney, Agent, or Firm*—William A. Drucker

[57] ABSTRACT

An electromagnetic contactor is fitted with an electromagnet sensitive to overcurrents, to cause the limitation and cut-off of excess currents.

A movable contact bridge is controlled by a spring which holds it against the fixed contacts, and is struck by at least one component which is not connected to it, and which is positioned between it and the armature of the control electromagnet.

9 Claims, 10 Drawing Figures

ELECTROMAGNETIC CONTACTOR IS FITTED WITH AN ELECTROMAGNET SENSITIVE TO OVER-CURRENTS, TO CAUSE THE LIMITATION AND CUT-OFF OF EXCESS CURRENTS

The invention concerns an electromagnetic contactor whose contacts open quickly when overcurrents appear in the circuit closed by the latter, comprising:

an electromagnet to control at least one mobile contact, a device sensitive to an overcurrent and consisting of a coil placed in the circuit and a pole core, the latter being associated with a striker which acts on the mobile contact to separate it from the fixed contact, locking means which hold the striker in the position corresponding to the appearance of the overcurrent, and a break switch which is placed in the supply circuit of the electromagnet and which is opened when the core is attracted by the coil.

An apparatus conforming to the structure defined above is known from German Pat. No. 735,838, wherein the striker's stroke is too short for the mobile contact to assume a position which is far enough from the fixed contact. It was consequently necessary to associate with the mobile contact a device making it possible to increase the latter's stroke before the opening of the electromagnet circuit puts said contact in its rest position.

The invention then proposes, on the one hand to provide a limiting contactor in which the opening of the contacts when overcurrents appear in the circuit is quick enough to confer on it the current limiting properties which are nowadays necessary even in apparatus whose rated current is relatively low, and on the other hand to keep the tripping threshold constant when the apparatus ages.

According to the invention, this result is achieved by the fact that the mobile contact is a symmetrical contact bridge associated with a first resilient return component positioned in the axis of symmetry which stretches to apply it to two fixed contacts, that the core associated with the coil transmits its movement to the contact bridge concentrically to said axis between the electromagnet armature and the contact bridge, that the striker travels a stroke of such a kind that the position imparted to the contact bridge when the core is held by the locking means is sufficient to cause current limitation, and that a thrust rod transmitting the movements of said armature to said contact bridge, without being connected to the latter, moves in said axis of symmetry, second resilient return components acting on the armature to cause the separation of the contact bridge from the fixed contacts when the electromagnet is not energized.

Also known, e.g. from U.S. Pat. No. 3,407,368, is circuit-breaking apparatus wherein the coil and the core associated with it are arranged between the contacts and a control device; in this known apparatus where the core is connected to the mobile contact, the position of the core when at rest, i.e. when the contacts are closed, as well as the resilient forces applied thereto, depend on the state of wear of the contacts so that the tripping threshold changes as it ages.

The invention, as well as the specific advantages provided by particular forms of embodiment, will be better understood from a reading of the description which follows and which is accompanied by the following figures.

Figure 1:
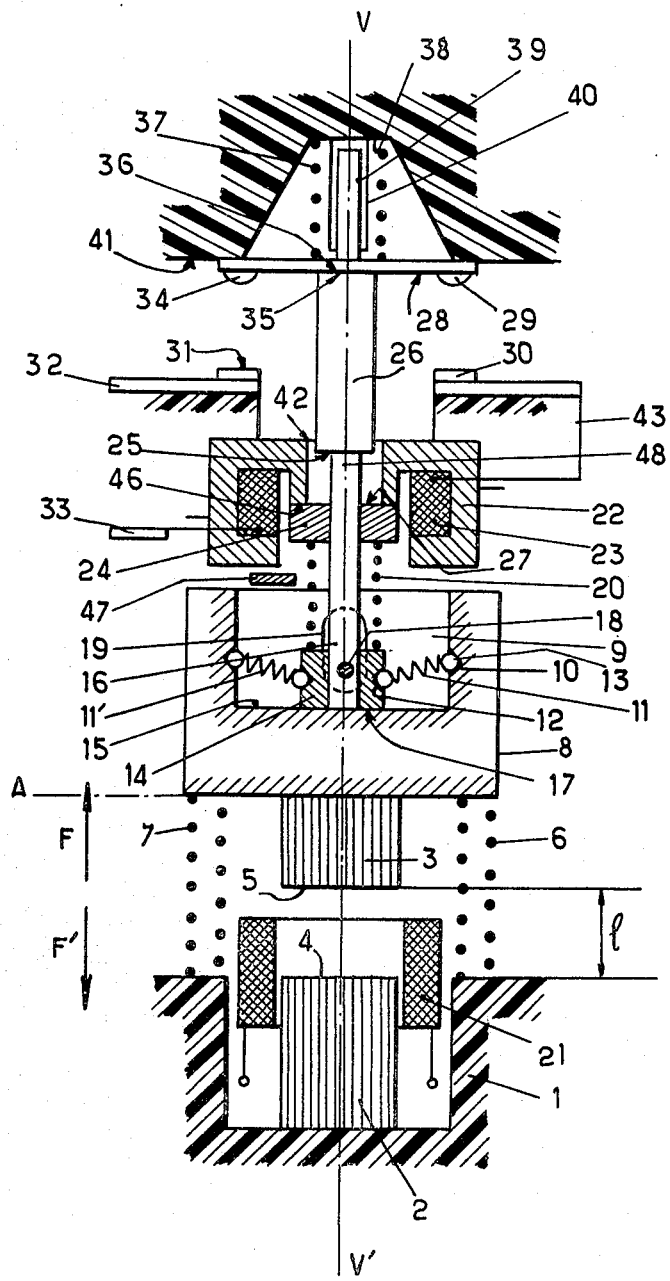
FIGS. 1 to 4 show a form of embodiment of the invention with a single transmission component, seen in longitudinal section and in different operating conditions.

FIG. 1 shows at (1) the casing of the apparatus which receives in particular the fixed yoke (2) of an electromagnet whose magnetizing coil is (21), two fixed contacts (30 and 31), the latter being connected to a connecting terminal (32), and an overcurrent-detecting magnetic circuit including, in the example illustrated here, a yoke (22) with an opening (42) through it and energized by a coil (23) a first terminal of which is connected to a connecting terminal (33) while the second terminal is connected to the fixed contact (30).

An armature (3) is associated with the electromagnet (2, 21) and carries a coupling member (8) which receives the resilient action of return springs (6), (7), which are positioned between it and the frame and stretch to separate the armature (3) from the yoke (2).

A longitudinally mobile movement transmission component (48) comprises two facing portions (16, 26) the first of which (16) is connected to the coupling member (8) by means of a resilient device passing through the neutral point including two compression springs (11, 11') whose opposite ends bear on the one hand on the coupling member at (13) and on the other hand at (12) on a bearing piece (14) integral with said first portion (16); the second end (26) which is positioned close to the fixed contacts and between these, can transmit a movement to a contact bridge (28) carrying two mobile contacts (29) and (34) which are permanently subjected to the resilient force of a pressure spring (37) which bears on a surface (38) of the casing and stretches to apply the mobile contacts to the fixed contacts.

Because of its resilient connection to the coupling member, itself guided in translation, and to guide means, not shown, the transmission component (48) has the same movement imparted to it as the coupling member (8) and moves longitudinally when the electromagnet is energized, and when the latter is de-energized.

In the position illustrated in FIG. 1, where the apparatus is in the open condition, the armature (3) is separated from the yoke (2) and a surface (17) of the bearing piece (14) is applied by the springs (11, 11') to a reference surface (15) of the coupling member (8) because the application points (12) of the springs are closer to said reference surface than the application points (13).

In this position, a front surface (36) positioned at the end (26) of the thrust rod (48), is applied to the surface (35) of the contact bridge (28) and applies the latter against a stop (41) on the casing, opening the circuit and compressing the spring (37).

Guide means (39) and (40) associated respectively with the contact bridge (28) and a portion integral with the casing (1), provide a substantially parallel movement of the bridge. These guide means can advantageously be positioned concentrically to the spring (37).

If the electromagnet is energized, the armature (3) moves towards the bottom of the figure taking with it the coupling member (8), which compresses the return springs (6, 7).

This coupling member (8) in turn brings with it the transmission component (48) which, because of the holding action of the springs (11, 11') can be considered to be integral in this movement.

Figure 2:
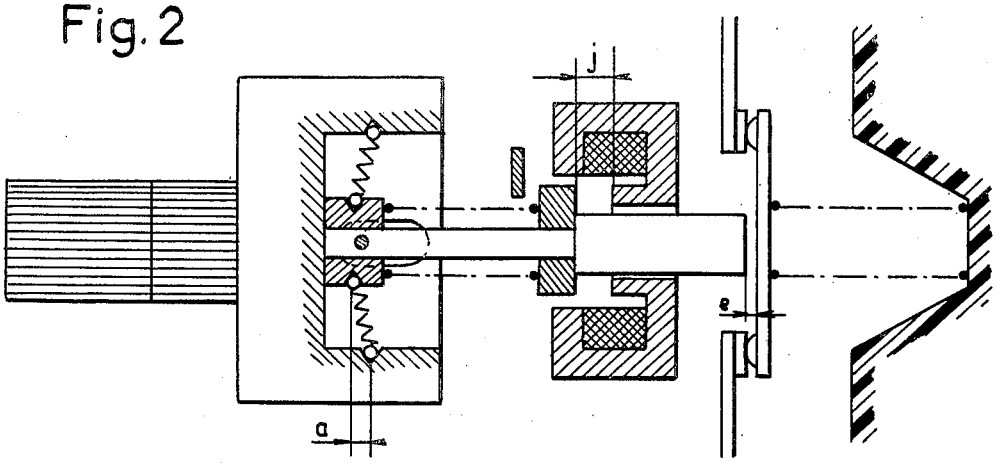

When the armature is applied to the core, the components of the apparatus are in the position indicated in FIG. 2 which corresponds to the closed condition. In this position, the mobile contacts of the bridge are applied by the spring (37) to the fixed contacts (31, 30) and the front surface (36) of the thrust rod is separated from the surface (35) of the bridge by a distance measured by the dimension (e).

The contact pressure is consequently independent of the state of the mobile parts, and the position of the transmission component does not depend on the wear of the contacts.

The magnetic yoke whose presence has been mentioned above cooperates with a mobile pole core (24) which is crossed by the central area of the transmission component and can slide on the latter. As can be seen in FIG. 1, a return spring (20) positioned concentrically to this component applies the core to a shoulder (25) of said component bearing on the piece (14) which is integral with it. The one-way coupling between the core and the transmission component enables the armature to travel a stroke (1) greater than the distance j which separates the surface (27) of the core from the polar surface (46) of yoke (22), see FIGS. 1 and 2.

Figure 5:
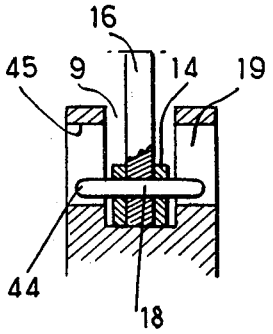
FIG. 5 shows a constructional detail of the holding device passing through the neutral point.

Piece (14) and the transmission component can be fixed together by a transversal cotter (18), which can also be seen in FIG. 5, which also serves a coupling function with play between the transmission component and the coupling member. For this purpose, at least one end (44) of cotter (18) is positioned in a longitudinal groove (19) in the coupling piece, whose dimensions are such that the position which the transmission component can assume in relation to the coupling piece when piece (14) is separated from surface (17) is determined by the contact between the end (44) of the cotter and the end (45) of the groove (19).

When a strong enough current is circulating in the circuit, the ferro-magnetic core (24) is attracted by the yoke and transmits to the transmission component a force directed towards the right of the figure.

When this force is greater than the resultant of the forces exerted by the springs (11, 11') of the device passing through the neutral point, the transmission component is moved suddenly to the right and causes the separation of the fixed and mobile contacts. Consequently, the transmission component (48) acts as a thrust rod transmitting the movement of the armature (3) and of a striker tripped by the core (24).

During a first phase of the tripping movement, the transmission component travels a stroke (a), see FIG. 2, before passing the neutral point. If the value of this stroke is less than the value of distance (e), the contact bridge will be struck, during the following phase, at a speed which will result from the acceleration transmitted to the mass of the transmission component by the attractive force of the core (24) and by the longitudinal force resulting from the decompression of the springs (11, 11'), the resultant of which is now directed towards the right of the figure.

Figure 3:
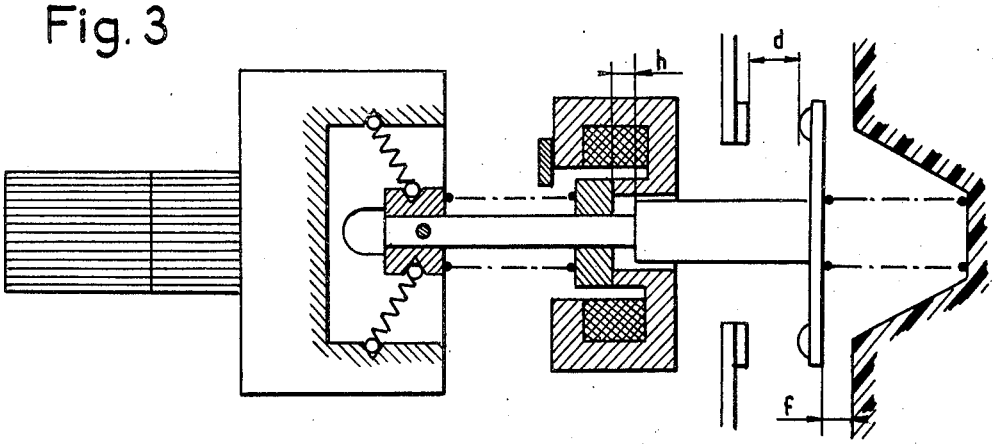

In the state of opening illustrated in FIG. 3, where the armature (3) is still applied to the fixed yoke of the electromagnet (2, 4), the cotter (18, 44) which can be seen in FIG. 5 is itself applied to the surface (45) of the coupling member (8), which determines the position of the transmission component and, consequently, the contact opening dimension (d).

During the tripping process which has just been described, the surface (27) of core (24) has been applied to the polar surface (46) of the yoke; in this condition a play (h) can separate the surface (27) from the shoulder (25) against which it was applied.

It can be seen that by means of the arrangements described above, the tripping threshold in the presence of a given overcurrent is defined solely by the geometrical arrangement of the components of the device passing the neutral point, by the position of the core and by the masses of the mobile parts.

When the apparatus has to cut off a multiphase supply line, switching units identical to the one which has just been described are associated with the coupling member for each phase.

In this case, it is necessary to cause, immediately after the opening of the circuit of the phase where there has been an overcurrent, the opening of the circuits of the neighbouring phases.

For this purpose, an auxiliary plate (47) can be associated with each yoke such as (22) to cause the opening of the energizing circuit of the electromagnet; this plate will, in known fashion, cause the opening of said energizing circuit at a current lower than that causing the tripping of the neutral point device in order, by a normal-speed cut-off, to protect the charge supplied by the apparatus from less strong overcurrents.

Figure 4:
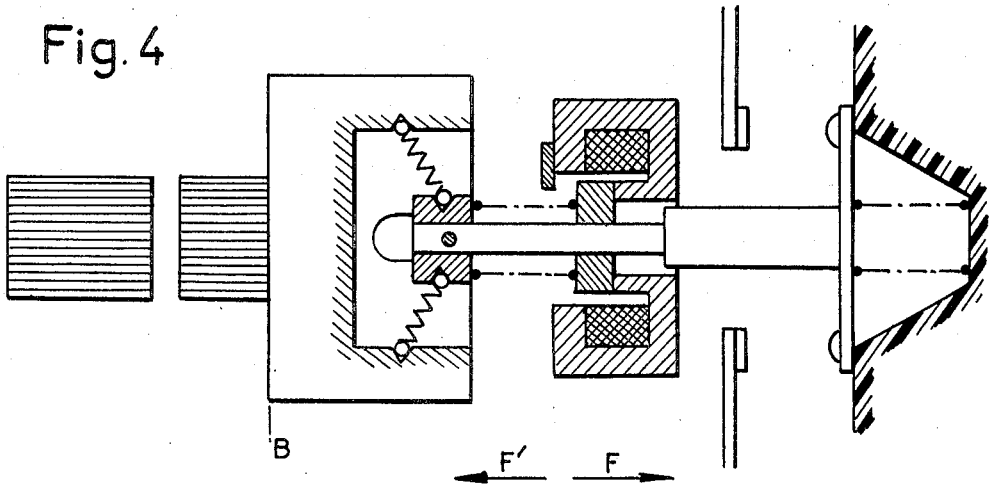

The general opening position, after a tripping caused by a very strong overcurrent, is shown in FIG. 4, where the fixed and mobile contacts of all phases are open; in this condition, the coupling member assumes a position (B) which is less distant from the electromagnet (2, 4) than is position (A) corresponding to normal opening, without an overcurrent appearing, this because of the position which the springs (11, 11') have assumed.

This position makes it possible to obtain, for the poles which have not had the strong overcurrent through them and whose neutral point devices remain in the position shown in FIGS. 1 and 2, a contact opening distance equal to the distance referenced (f) in FIG. 3.

A reset component, not shown, makes it possible to act either on the coupling member in the direction of arrow F or on the contact bridge in direction F' in order to regain the position illustrated in FIG. 1.

Figure 9:
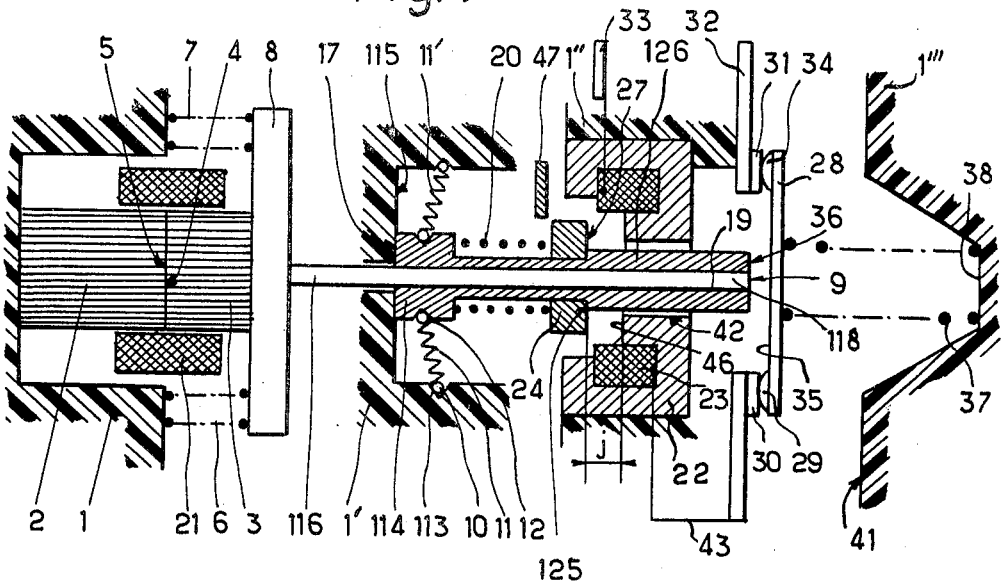

In the variant of embodiment illustrated in FIG. 9, where components which fulfil the same functions bear the same references, the functions of the common component, which served both to operate the mobile contact normally and to strike it in case of overcurrent, have been separated in such a way as to obtain not only greater freedom in the respective movement of the parts but also some degree of independence between the manufacturing tolerances of the components necessary respectively to carry out these functions.

The thrust rod (116), one end of which is still associated with the movements of the armature, is now cylindrical and terminates, as in the previous case, in an end (118) positioned close to the contact bridge (28).

Here again the yoke (22) and the coil (23) cooperate with a metal part (24) which can take the form of a ring or that of a plunger. In the ensuing lines, this part will be called a core.

The core (24) is carried by a tubular portion (126) which constitutes a striker and whose sole function is to break the circuit when a sufficient overcurrent appears; the striker is threaded without friction on the thrust rod for which it may possibly constitute the guide sheath. The portion (114) positioned at one end of the striker on the armature side is applied in its rest position to a fixed bearing (115) of the casing by the axial component of two springs (11, 11') constituting as in the previous case a holding device passing through the neutral point. It will nevertheless be seen that the ends (10) of these springs now bear against portions of the casing which are also fixed, such as (113).

The core (24) whose position in relation to the polar surfaces of the yoke (22) is determined by its bearing on a skirt (125) of the striker, is kept at rest in this position by a locking spring (20). It can be seen that in this form of embodiment all the components whose dimensions determine the gap (j) are components which are either fixed in relation to the casing which carries them or components which bear on the latter.

The achievement of a gap (j) of a given dimension and the assembly dimensions of the holding device are therefore easier to adhere to and consequently the tripping threshold is not only better established but is also very consistent during the ageing of the apparatus, caused e.g. by contact wear.

As in the previous example, the resetting of the apparatus can be achieved by manual action exerted either on the contact bridge or on the striker.

The holding device, illustrated in FIGS. 1 to 4 and 9, can assume particular shapes and variants which must all provide two stable positions for the striker, a first position where the core is held at a given distance from the polar pieces with which it cooperates and a second position corresponding to tripping caused by an overcurrent at which the end of the striker separates the mobile contact bridge from the fixed contacts, this by such a distance that the overcurrent is effectively limited.

Figure 6:
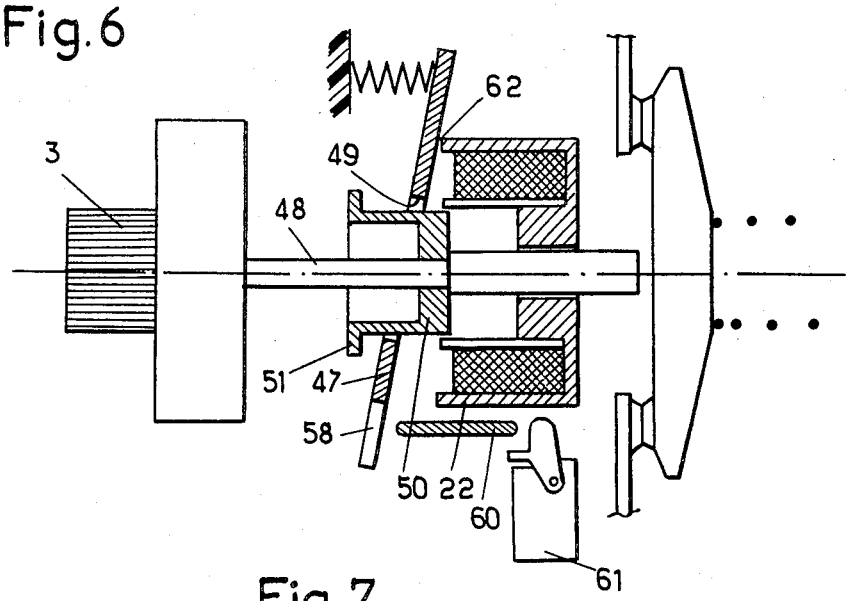
FIGS. 6 and 7 illustrate, by two sections made in perpendicular planes, the details of a second type of holding or locking device.
Figure 7:
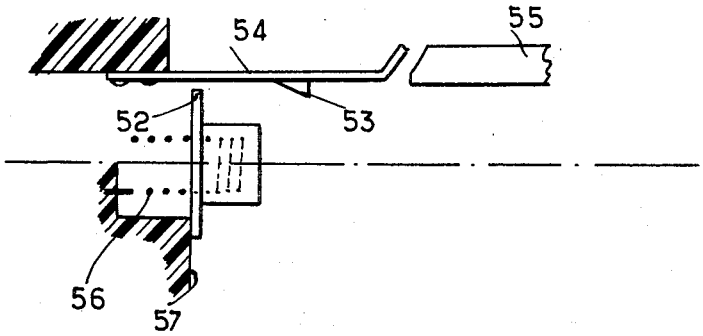

An advantageous form of embodiment of the holding device shown in FIGS. 6 and 7 allows the plate (47) mentioned above in the first form of embodiment to cooperate with the yoke without requiring an excessive amount of space.

The plate (47) which is pivoted on an edge (62) of the yoke (22) has an opening (49) in it positioned in the axis of the movement transmission component (48). The cylindrical core (50) is mounted on this component in a way similar to the one shown in FIG. 1 and has a side skirt or extension (51) whose flange (52), which can be seen in FIG. 7, locks under a hook (53) integral with a resilient blade (54) when the core (50) has been attracted by the yoke (22).

Here again a hand-controlled component (55) allows the core to be released by bending the resilient blade to return it to its rest position; this position is here obtained by the resilient force exerted by the spring (56) which places the skirt against a bearing surface (57) of the frame, see FIG. 7.

Figure 8:
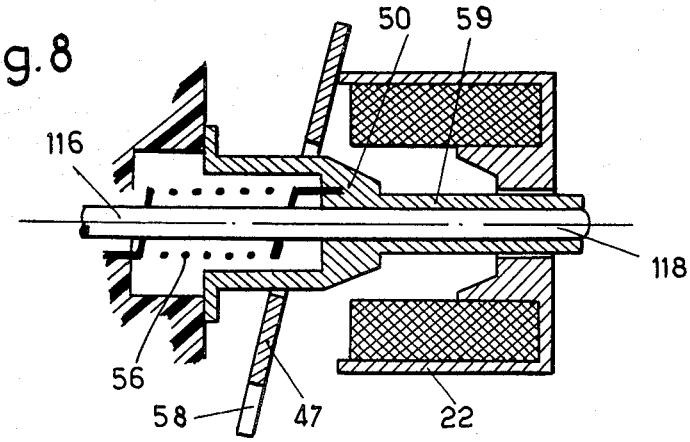
FIGS. 8 and 9 show two forms of embodiment in which the functions of the striker and of the thrust rod are carried out by separate parts.

In the variant shown in FIG. 8 and particularly applicable to an apparatus which uses a striker and a thrust rod, the striker (59) integral with the core (50) can be tubular over its whole length, encircle the thrust rod (118) and extend to the vicinity of the contact bridge. The locking device can be identical to the one illustrated in FIG. 7.

In FIGS. 6 to 8, the end (58) of the plate opposite the pivoting axis is associated in a known way with the operating component (60) of a break switch (61) which is to break the current circulating in the coil (21) of the operating electromagnet when the current circulating in the main circuit reaches, e.g., ten times the rated current of the apparatus.

The function of this plate is therefore to confirm, by cutting off the control electromagnet supply current, the separation of the fixed and mobile contacts when this has been caused by the action of the striker, as well as to obtain the separation of the contacts on the poles which have not been subjected to the strong overcurrent which caused the tripping.

Figure 10:
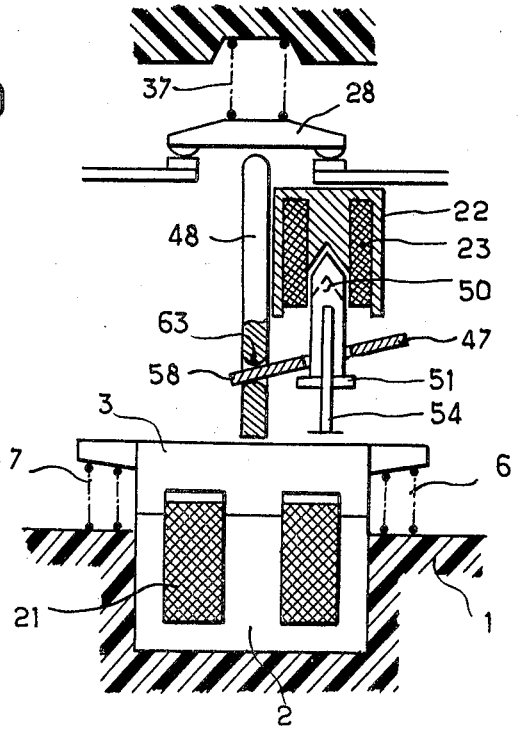
FIG. 10 shows a form of embodiment in which the coil and the core are not axisymmetrical.

In the form of embodiment illustrated in FIG. 10, where the components with the same functions as in the previous examples bear the same references, the yoke (22), the coil (23), the plate (47) and the core (50) are not arranged in the axis of the single component (48) acting as a thrust rod and striker.

This component has between its ends, positioned as above in the axis between the contact bridge (28) and the armature (3), a notch or opening (63) into which the end (58) of the plate penetrates.

Here again, when the current is strong enough, the core (50) rocks the plate (47) to cause the raising of the bridge via the component (48) and retains its attracted position by locking the flange (51) under the hook on the resilient blade (54).

We claim:

1. An electro-magnetically controlled current limiting circuit breaker comprising:

(a) a housing, (b) at least two stationary contacts arranged within the housing in spaced apart electrically isolated relation, (c) a movable contact bridging member in said housing, having first and second sides and a pair of contact portions engageable with said stationary contacts respectively, (d) operating means for longitudinally moving said movable contact bridging member between an open position in which said contact portions are out of engagement with said stationary contacts and a closed position in which said contact portions are in engagement with said stationary contacts, and (e) an electro-magnetic actuator having a longitudinally movable armature, (f) means for energizing the said actuator, whereby, when the said energizing means are operative, the said armature is moved from a first position in which the said armature is separate from the actuator to a second position in which the said armature is attracted by this actuator, (g) second resilient means resetting the armature into said first position when the energizing means are not operative, (h) said operating means comprising first resilient means located on said first side between said bridging member and said housing and adapted to move said bridging member into said closed position, and thrust means located on said second side between said bridging member and said movable armature, and adapted to move said bridging member into said open position when said energizing means are not operative and said armature is in the first position, (i) said circuit breaker further comprising current-overload-responsive means located between said bridging member and said armature, (j) circuit means serially connecting the said overload responsive means and the said stationary contacts and bridging member, (k) said overload responsive means comprising a yoke, a coil and a longitudinally displaceable plunger having a first stable position in which it is engaging the said yoke, and a second stable position in which said plunger is separate from the said yoke, the first position being obtained when the current flowing through the said circuit means exceeds a predetermined value and the second position being obtained when the said current does not exceed the said predetermined value, (l) said circuit breaker further comprising striking means located between said bridging member and said armature, and adapted to cooperate with said plunger, for longitudinally moving said bridging member into a further position when said plunger is in its first stable position, the said further position being more remote from the stationary contacts than the said open position, (m) said striking means and thrust means acting on the surface of said bridging member, substantially at the same portion thereof.

2. An electro-magnetically controlled current limiting circuit breaker according to claim 1, wherein said thrust means, said striking means, said yoke and said plunger are symmetrically arranged about a same longitudinal axis.

3. An electro-magnetically controlled current limiting circuit breaker according to claim 1, wherein said thrust means and said striking means are coaxially arranged about a first axis, whereas said yoke and said plunger are arranged about a second axis parallel to the first axis.

4. An electro-magnetically controlled current limiting circuit breaker according to claim 1, said circuit breaker further comprising snap action resilient means which cooperate with the said striking means for defining the said two stable positions of the plunger.

5. An electro-magnetically controlled current limiting circuit breaker according to claim 4, said circuit breaker further comprising coupling means integral with the said armature for coupling the said armature to the striking means and to the thrust means, said snap action resilient means resiliently linking said coupling means to said striking means.

6. An electro-magnetically controlled current limiting circuit breaker according to claim 4, wherein said snap action resilient means are resiliently linking said housing to said striking means.

7. An electro-magnetically controlled current limiting circuit breaker according to claim 5, wherein the said plunger is coaxially arranged around a rod having one end which cooperates with the said surface portion of the bridging contact member and the other end which cooperates with the snap action resilient means and with the said coupling member.

8. An electro-magnetically controlled current limiting circuit breaker comprising:

(a) a housing, (b) at least two stationary contacts arranged within the housing in spaced apart electrically isolated relation, (c) a movable contact bridging member in said housing, having first and second sides and a pair of contact portions engageable with said stationary contacts respectively, (d) operating means for longitudinally moving said movable contact bridging member between an open position in which said contact portions are out of engagement with said stationary contacts and a closed position in which said contact portions are in engagement with said stationary contacts, and, (e) an electro-magnetic actuator having a longitudinally movable armature, (f) means for energizing the said actuator, whereby, when the said energizing means are operative, the said armature is moved from a first position in which the said armature is separate from the actuator and a second position in which the said armature is attracted by this actuator, (g) second resilient means resetting the armature into said first position when the energizing means are not operative, (h) said operating means comprising first resilient means located on said first side between said bridging member and said housing and adapted to move said bridging member into said closed position, and thrust means located on said second side between said bridging member and said movable armature, and adapted to move said bridging member into said open position when said energizing means are not operative and said armature is in the first position, (i) said circuit breaker further comprising current-overload-responsive means located between said bridging member and said armature, (j) circuit means serially connecting the said overload responsive means and the said stationary contacts and bridging member, (k) said overload responsive means comprising a yoke, a coil and a longitudinally displaceable plunger having a first stable position in which it is engaging the said yoke, and a second stable position in which said plunger is separate from the said yoke, the first position being obtained when the current flowing through the said circuit means exceeds a predetermined value and the second position being obtained when the said current does not exceed the said predetermined value, (l) said circuit breaker further comprising striking means located between said bridging member and said armature, and adapted to cooperate with said plunger, for longitudinally moving said bridging member into a further position when said plunger is in its first stable position, the said further position being more remote from the stationary contacts than the said open position, (m) said striking means and thrust means acting on the surface of said bridging member, substantially at the same portion thereof, (n) said overload responsive means further comprising a further armature having an aperture through which passes the said plunger, said further armature being displaceable from a first position which is obtained when the current flowing through the said circuit means exceeds a further predetermined value which is lower than the said predetermined value, to a second position which is obtained when the said current does not exceed the said further predetermined value, (o) said overload responsive means further comprising switch means serially connected with the energizing means of said electro-magnetic actuator and the further armature cooperating with said switch means to open said switch means when the said further armature is in its first position, (p) third resilient means mounted adapted for resetting said plunger into its second stable position, (q) resilient hook means mounted for latching said plunger into its first stable position, (r) said plunger having a projecting portion which cooperates with said further armature for displacing the said further armature into its first position when said plunger is displaced towards its first position.

9. An electro-magnetically controlled current limiting circuit breaker according to claim 8, wherein the said plunger is symmetrically arranged about a first axis which is set parallel to a second axis passing through the said surface portion, the operating means comprising a rod symmetrically arranged about the second axis, said rod having one end which cooperates with the said surface portion, another end which cooperates with the said armature and means for coupling the said further armature to said rod for displacement of the said rod by said further armature when the said further armature moves from its first to its second positions.

* * * * *